US007673836B2

(12) United States Patent
Wallock et al.

(10) Patent No.: US 7,673,836 B2
(45) Date of Patent: Mar. 9, 2010

(54) ADJUSTABLE HEAD AND WRIST SUPPORT

(75) Inventors: Ollie Wallock, 117 Winton St., Springfield, MA (US) 01118; John Dalsey, Longmeadow, MA (US)

(73) Assignee: Ollie Wallock, Springfield, MA (US)

( * ) Notice: Subject to any disclaimer, the term of this patent is extended or adjusted under 35 U.S.C. 154(b) by 357 days.

(21) Appl. No.: 11/430,631

(22) Filed: May 10, 2006

(65) Prior Publication Data

US 2007/0262208 A1 Nov. 15, 2007

Related U.S. Application Data

(60) Provisional application No. 60/679,060, filed on May 9, 2005.

(51) Int. Cl.
*B68G 5/00* (2006.01)
*A47C 20/00* (2006.01)

(52) U.S. Cl. ..... 248/118; 248/178.1; 5/622; 5/632

(58) Field of Classification Search ..... 248/118, 248/118.3, 125.8, 178.1; 5/613, 640, 622, 5/638, 643, 659, 632; 297/344.14, 394, 464
See application file for complete search history.

(56) References Cited

U.S. PATENT DOCUMENTS 245,639 A * 8/1881 Lay ..... 297/394
527,056 A * 10/1894 Gilson ..... 297/464
1,131,802 A * 3/1915 Stenshoel ..... 248/178.1
1,134,720 A * 4/1915 Bradley ..... 5/622
1,260,929 A * 3/1918 Maxcy ..... 297/394
1,356,365 A * 10/1920 Hosmer ..... 297/464
1,961,244 A * 6/1934 Pottern ..... 4/523
2,507,172 A * 5/1950 Naclerio ..... 5/622
3,026,079 A * 3/1962 Stack ..... 248/122.1
3,929,309 A * 12/1975 De Vore ..... 248/118
4,249,712 A * 2/1981 DeLong ..... 248/118
4,650,249 A * 3/1987 Serber ..... 297/313
4,858,991 A * 8/1989 Boyesen ..... 297/195.11
4,890,853 A * 1/1990 Olson ..... 280/87.021
5,408,713 A * 4/1995 Stratton et al. ..... 5/632
5,487,590 A * 1/1996 Haynes ..... 297/344.14
6,682,040 B1 * 1/2004 MacEachern ..... 248/349.1
6,857,149 B2 * 2/2005 Hoggatt et al. ..... 5/632
7,036,168 B1 * 5/2006 Knickerbocker ..... 5/640

* cited by examiner

*Primary Examiner*—Anita M King
(74) *Attorney, Agent, or Firm*—McCormick, Paulding & Huber LLP

(57) ABSTRACT

A device of the present invention for supporting a user's arms, head, and hands allowing the user to perform tasks requiring stability and fine motor movement, the device includes a base, at least two upright members operatively attached to the base, and support means operatively attached to each of the upright members.

15 Claims, 3 Drawing Sheets

ADJUSTABLE HEAD AND WRIST SUPPORT

CROSS-REFERENCE TO RELATED APPLICATIONS

The present application claims the benefit of U.S. Provisional Patent Application No. 60/679,060 filed on May 9, 2005, herein incorporated by reference in its entirety.

FIELD OF THE INVENTION

The present invention relates generally to an apparatus that supports a user's head and wrists. More particularly, the present invention relates to an adjustable head rest and arm/wrist support that may be employed to stabilize a user's head and arms so that they may insert a contact lens or perform a similar task.

BACKGROUND OF THE INVENTION

Individuals who are functionally blind due to eye injuries or diseases of the cornea often use rigid gas permeable ("RPG") contact lenses. In particular, such individuals often utilize a Boston Scleral Lens™ (a "Scleral™ lens"), developed at the Boston Foundation for Sight™.

When inserting an RGP lens, and particularly a Scleral™ lens, which contains a large volume of fluid, it is critical that the wearer keep the lens aligned with the wearer's eye. The alignment involves both centering the lens on the eye and aligning the lens on a perpendicular axis to the eye. The lens must be centered, square and level to the eye for a successful insertion.

If a Scleral™ lens is misaligned during insertion, the fluid will spill out. Moreover, a slight misalignment of an RPG or Scleral™ lens may cause the lens to hit the wearer's eyelid or finger and fall out. Additionally, insertion of a lens such that it is only partly on the cornea or in the corner of the eye can cause injury. Even if an imperfect alignment does not cause injury but aligns by flipping onto the sclera, there is a good chance that bubbles will be formed in the fluid reducing the efficacy of the lens.

Accordingly, insertion of such lenses requires precise movements of a wearer's hands in addition to a stabilized head. Many elderly wearers simply do not have steady enough hands to insert their lenses. Other wearers are on medications or may have a degenerative condition affecting their fine motor movements rendering insertion of such lenses extremely difficult.

Additionally, people with diminished fine motor movements, such as those described above, may have difficulty applying make-up, especially eye make-up, and using tweezers around their eyes and face. Moreover, such people may not be able to perform activities such as sewing, knitting, tying fishing line, writing or drawing.

An embodiment of the present invention addresses these problems by providing an adjustable support on which a user's arms/wrists can be supported and the user's head can be comfortably stabilized in relation to the hands in order to allow the precise movements of the hands and fingers.

SUMMARY OF THE INVENTION

It is an object of the present invention to provide a support device that enables an individual with impaired or diminished fine motor movement to perform a variety of tasks requiring stable arms, hands and/or head.

It is a further object of the present invention to provide an adjustable support device that supports and stabilizes a user's arms, hands and head.

It is an additional object of the present invention to provide an adjustable support device that supports and stabilizes a user's arms, hands and head facilitating the alignment and insertion of a contact lens.

It is yet another object of the present invention to provide an adjustable support device that supports and stabilizes a user's arms, hands and/or head so that the user may apply make-up and perform activities such as sewing, knitting, tying fishing line, writing or drawing.

A preferred embodiment of the support device of the present invention includes a base, at least one upright member operatively attached to the base, and a support means operatively attached to the upright member.

This and other objects and advantages of this invention will be more readily appreciated from a reading of the application in conjunction with the drawings annexed hereto as follows.

DETAILED DESCRIPTION OF THE PREFERRED EMBODIMENT

Figure 1:
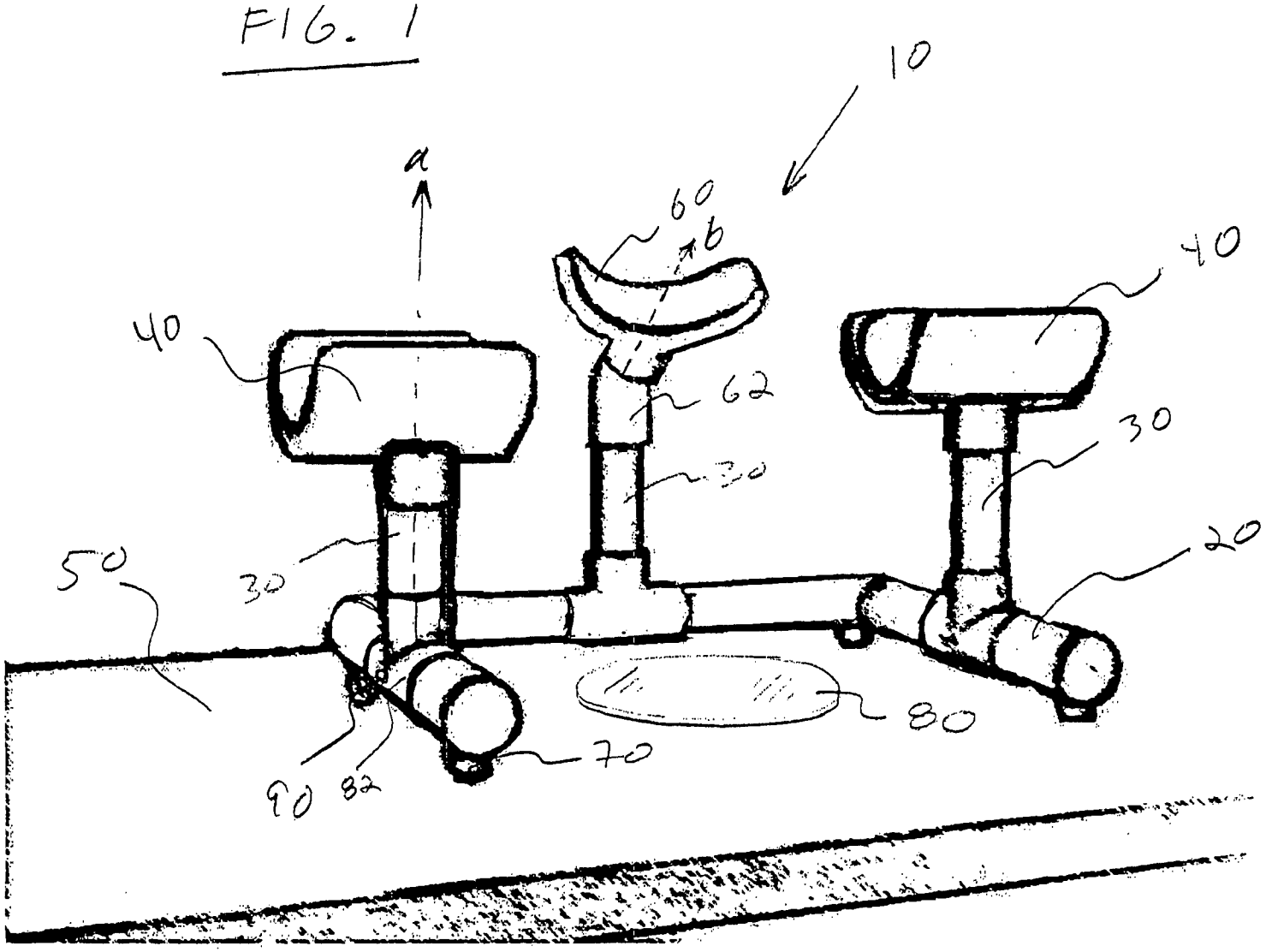
FIG. 1 is a perspective view of an embodiment of the support device of the present invention.

Referring to FIG. 1, a preferred embodiment of the support device 10 of the present invention includes a base 20, upright members 30, hand/wrist supports 40, and a head support or rest 60. The upright members 30 are operatively connected to the base 20 and the supports 40, 60 are operatively connected to the upright members 30.

The base 20 is typically placed on a table 50 for use. The base 20 is preferably U-shaped so a mirror 80 may be placed on the table 50 between the hand/wrist supports 40 such that a user can visualize their eyes and face to insert a lens or apply make-up. The U-shaped base 20 has three sections of tubing each extending longitudinally in a plane parallel to the plane of the table 50. As will be appreciated, the mirror 80 may also be mounted on the base 20.

The base 20 preferably includes skid-resistant pads 70 that prevent the base 20 from sliding on the table 50. As will be appreciated, the pads may be manufactured from rubber or a like skid resistant substance. The base 20 may be manufactured from a variety of materials including PVC piping. The materials, however, should be of a weight that allows the device to be easily moved.

Still referring to FIG. 1, the upright members 30 are operatively connected to the base 20 through a coupling or joint 82. The upright members 30 extend upward toward the user in a plane substantially perpendicular to the plane of the table 50 and base 20. Preferably, the upright members 30 are moveable about the portion of the base 20 to which they are attached. The upright members 30 may be moved in a plane parallel to the plane of the table 50. The upright members 30 may be secured in position along the base 20 through a knob/pin 90 which extends into a hole (not shown) in the base 20. As will be appreciated, the knob/pin 90 may include a biasing means (not shown) to fixedly hold the pin 90 in the hole on the base 20.

The device 10 also includes support means 40, 60, which include the wrist/arm supports 40 and head rest 60. The support means 40, 60 are operatively connected to the upright members 30 preferably through a coupling or joint. The wrist/arm supports 40 are rotatable about an axis a. The wrist/arm supports may also be raised or lowered about the upright members 30 in a plane perpendicular to the plane of the table 50. The mechanism for raising/lowering and securing the wrist/arm supports may also be a knob/pin with biasing means and a hole as described above. The wrist/arm supports 40 are preferably padded, are unshaped or concave, and are sized to fit the majority of a user's forearm so that a user may comfortably maintain their arm/wrist in the support 40 for an extended period of time.

An important aspect of the present invention is the adjustability of the arm/wrist supports 40. The support means 40, 60 should be adjustable to accommodate both the size, i.e., height, of the user and the particular activity of the user. The support means 40, 60 must also be stable and secure enough to permit the user to place a relatively significant portion of their body weight on the support means 40, 60 while inserting the lens or performing another activity.

Figure 2:
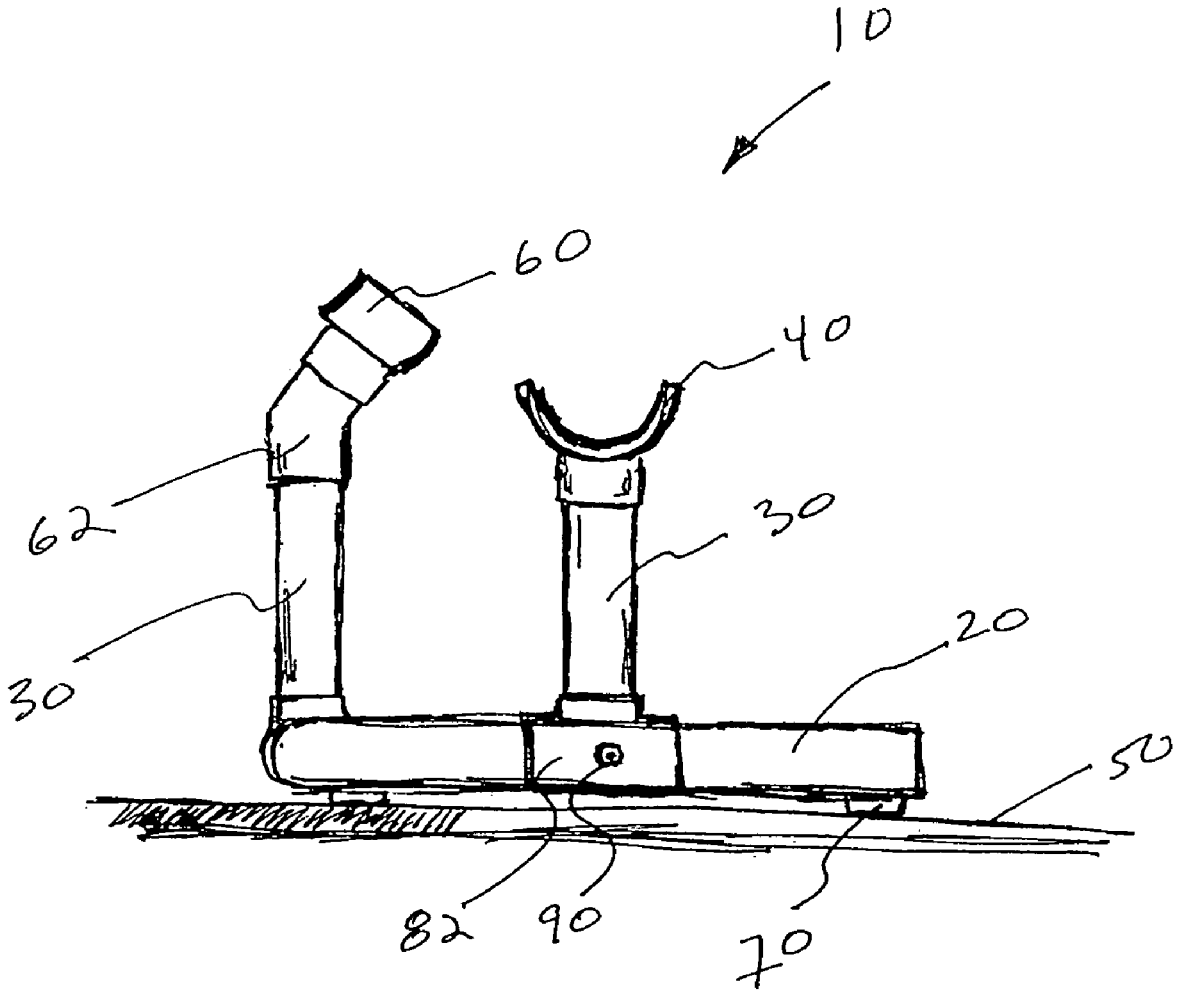
FIG. 2 is a side view of the support device of FIG. 1.

Referring now to FIG. 2, the head rest 60 is operatively connected to the base 20. Preferably, the head rest is connected to the base through a joint or coupling. The head rest coupling or joint 62 is preferably bent or angled toward the user to ensure a comfortable, natural position of the head. The head rest 60 is rotatable about an axis b to accommodate different activities of the user. As will be appreciated, the head rest should be curved or concave and padded to comfortably support a user's head. The head rest 60 should also be adjustable about the upright member 30 in a plane perpendicular to the plane of the table 50 as described above. The upright member 30 supporting the head rest 60 may be movable about the base 20 in a plane parallel to the plane of the table 50 in the same fashion as described above for the uprights 30 supporting the arm/wrist supports 40.

An important aspect of the present invention is the adjustability of the head rest 60. As with the arm/wrist supports 40, the positioning of support in order to comfortably support a user's head is critical. The user's head must be comfortably supported and stabilized to facilitate insertion of a lens. The user must also be able to adjust the head rest so that it may effectively utilize a mirror 80 (FIG. 1). The mirror 80 would assist in inserting conventional contact lenses, i.e., non-Scleral™ lenses, applying makeup, utilizing tweezers and like.

Figure 3:
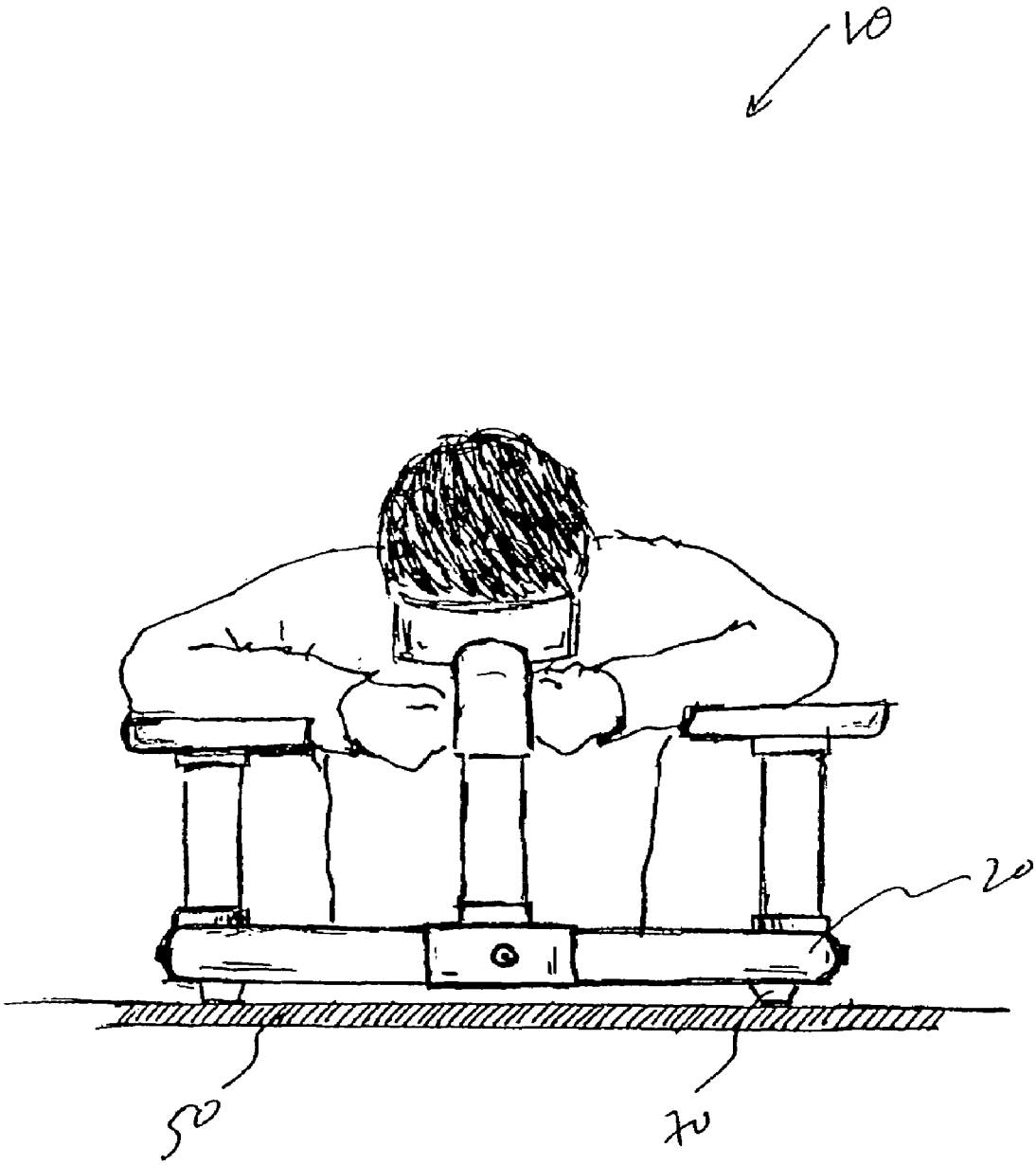
FIG. 3 is a front view of the support device of FIG. 1 illustrating the head and arms of a user in the support device.

Referring now to FIG. 3, in order to use the device 10 to insert a lens, the user must place its arms/wrists in the arm/wrist supports 40. Typically, the user will have already adjusted the supports 40 and head rest 60 to a comfortable position. The user then places its head in the head rest 60 in a comfortably position to that it is stabilized. The user then aligns the lens and inserts it into the user's eye.

The foregoing description is intended to describe the preferred form of the invention and the best mode contemplated by us for carrying out this invention. To those skilled in the art, however, various modifications and variations to the specific embodiments described herein may be apparent without departing from the scope of the invention.

What is claimed is:

1. A device for supporting a user's arms, head, and hands allowing the user to perform tasks requiring stability and fine motor movement in combination with a mirror for assisting the user to perform tasks requiring fine motor skills, said device comprising:

a base to secure and stabilize said device on a substantially flat surface;

at least two upright members operatively attached to said base;

a support means operatively attached to each of the upright members, said support means configured to comfortably support and stabilize the head and at least one arm of a user allowing the user to perform tasks that require fine motor movement;

wherein each of said support means are rotatable about an axis through each of said upright members; and wherein the mirror is positioned adjacent the base.

2. The device of claim 1 wherein the base is substantially u-shaped.

3. The device of claim 2 wherein said at least two upright members are three uprights members, a first upright member to support a user's head and second and third upright members to support each of a user's arms.

4. The device of claim 3 wherein the support means operatively attached to each of the three upright members is substantially concave and padded to comfortably support the head and arms of a user.

5. The device of claim 1 wherein said upright members are in planes substantially perpendicular to said base and may be raised or lowered in the plane perpendicular to the base.

6. The device of claim 5 wherein said support means attached to a first connecting member is angled toward a user.

7. A device for supporting a user's arms, head, and hands allowing the user to perform tasks requiring stability and fine motor movement in combination with a mirror for assisting the user to perform tasks requiring fine motor skills, said device comprising:

a substantially u-shaped base to secure and stabilize said device on a substantially flat surface;

three upright members operatively attached to said base, said upright members including a first upright member to support a user's head and a second and third upright member to support each of a user's arms;

a support means operatively attached to each of the upright members, said support means configured to comfortably support and stabilize the head and at least one arm of a user allowing the user to perform tasks that require fine motor movement;

wherein each of said support means are rotatable about an axis through each of said upright members; and wherein the mirror is positioned adjacent the base.

8. The device of claim 7 wherein the support means operatively attached to each of the three upright members is substantially concave and padded to comfortably support the head and arms of a user.

9. The device of claim 7 wherein said upright members are substantially perpendicular to said base and said support means attached to said first connecting member is angled toward a user.

10. A device for supporting a user's arms, head, and hands allowing the user to perform tasks requiring stability and fine motor movement in combination with a mirror for assisting the user to perform tasks requiring fine motor skills, said device comprising:

a substantially u-shaped base to secure and stabilize said device on a substantially flat surface;

three upright members operatively attached to said base, said upright members including a first upright member to support a user's head and a second and third upright member to support each of a user's arms;

a support means operatively attached to each of the upright members, each of said support means being rotatable about an axis through each of said three upright members and said support means are substantially concave and padded to comfortably support the head and arms of a user allowing the user to perform tasks that require fine motor movement; and wherein the mirror is positioned adjacent the base.

11. The device of claim 10 wherein said upright members are substantially perpendicular to said base and said support means attached to said first connecting member is angled toward a user.

12. The device of claim 10 wherein said base and upright members are manufactured from PVC tubing.

13. The device of claim 10 wherein said base includes skid-resistant pads to prevent the base from sliding on a surface.

14. The device of claim 10 wherein said upright members are in planes substantially perpendicular to said base and may be raised or lowered in the plane perpendicular to the base.

15. A device for supporting a user's arms, head, and hands allowing the user to perform tasks requiring stability and fine motor movement in combination with a mirror for assisting the user to perform tasks requiring fine motor skills, said device comprising:

a base to secure and stabilize said device on a substantially flat surface, at least two upright members operatively attached to said base;

a support means operatively attached to each of the upright members, said support means configured to comfortably support and stabilize the head and at least one arm of a user allowing the user to perform tasks that require fine motor movement;

wherein at least one of said support means is rotatable about an axis through each of said upright members; and wherein the mirror is positioned adjacent the base.

* * * * *

UNITED STATES PATENT AND TRADEMARK OFFICE

CERTIFICATE OF CORRECTION

PATENT NO. : 7,673,836 B2
APPLICATION NO. : 11/430631
DATED : March 9, 2010
INVENTOR(S) : Ollie Wallock and John Dalsey It is certified that error appears in the above-identified patent and that said Letters Patent is hereby corrected as shown below:

Assignee:

Patent Cover Page, Section (73), please delete the assignee:
"Ollie Wallock, Springfield, MA (US)."

Signed and Sealed this
Twelfth Day of February, 2013

Teresa Stanek Rea
*Acting Director of the United States Patent and Trademark Office*